United States Patent [19]

Nakamura et al.

[11] Patent Number: 4,496,288

[45] Date of Patent: Jan. 29, 1985

[54] VANE TYPE PUMP WITH A VARIABLE CAPACITY FOR POWER STEERING DEVICES

[75] Inventors: Keiichi Nakamura, Kariya; Yoshiharu Inaguma, Nagoya; Yutaka Mori, Toyokawa, all of Japan

[73] Assignee: Toyoda Koki Kabushiki Kaisha, Kariya, Japan

[21] Appl. No.: 452,136

[22] Filed: Dec. 22, 1982

[30] Foreign Application Priority Data

Dec. 22, 1981 [JP] Japan ..... 56-207745

[51] Int. Cl.[3] ..... F04B 49/00

[52] U.S. Cl. ..... 417/213; 417/220; 417/310; 418/30; 418/31

[58] Field of Search ..... 91/497; 417/220, 218, 417/310, 213; 418/26, 27, 30, 31

[56] References Cited

U.S. PATENT DOCUMENTS

| | | | |
|---|---|---|---|
| 2,635,551 | 4/1953 | De Lancey | 417/220 |
| 2,985,109 | 5/1961 | Ernst | 103/120 |
| 3,743,445 | 7/1973 | Dworak et al. | 417/220 |

FOREIGN PATENT DOCUMENTS

| | | | |
|---|---|---|---|
| 2017036 | 4/1971 | Fed. Rep. of Germany | 417/220 |

OTHER PUBLICATIONS

Japanese Published Unexamined Patent Application No. 56-143384, Filed: Apr. 10, 1980, Published: Nov. 9, 1981.

Japanese Published Unexamined Utility Model Application No. 54-123539, Filed: Feb. 20, 1978, Published: Aug. 29, 1979.

*Primary Examiner*—Edward K. Look

*Attorney, Agent, or Firm*—Oblon, Fisher, Spivak, McClelland & Maier

[57] ABSTRACT

A vane type pump with a variable capacity for power steering devices is provided with a movable ring received and radially movable in a closed cylindrical bore of a pump housing. A spring acts on the movable ring to deflect the axis of the movable ring from the axis of a rotor, which is rotated to move vanes along an internal bore of the movable ring. A sealing pin and a valve element are provided at diametrically opposite sides of the movable ring and define first and second pressure chambers around the movable ring. The first pressure chamber receives pressurized fluid from a part of the internal bore of the movable ring and conducts the pressurized fluid into the second pressure chamber through a throttle, which is defined by the valve element and a part of a circumferential external surface of the movable ring. The throttle generates a pressure difference between the first and second pressure chambers, and the pressure difference acts on the movable ring to move the same against the force of the spring. The pump is further provided with a solenoid operated actuator for adjusting the position of the valve element, and a relief valve.

8 Claims, 7 Drawing Figures

VANE TYPE PUMP WITH A VARIABLE CAPACITY FOR POWER STEERING DEVICES

BACKGROUND OF THE INVENTION

1. Field of the Invention

The present invention relates to a vane type pump for power steering devices of the kind wherein the eccentricity of the axis of a cylindrical bore formed in a movable member from the axis of a rotor rotating in the cylindrical bore is changed in response to a pressure drop across a throttle which is disposed on a fluid line connecting a pump discharge port with an actuator, for maintaining a constant discharge volume of pressurized fluid.

2. Description of the Prior Art

In known vane type pumps of the aforementioned kind, a pressure chamber defined by an internal surface of a pump housing and an external surface of a movable ring received in the pump housing is divided into first and second pressure chambers. Pressurized fluid compressed by a rotor rotated in the movable ring is led to one of the first and second pressure chambers and is further led through a throttle to an actuator and the other of the first and second pressure chambers. The pressure difference before and behind the throttle acts on the movable ring and causes it to move in the radial direction of the movable ring. This movement of the movable ring changes the eccentricity of the movable ring relative to the rotor, so that the volume of pressurized fluid supplied to the actuator can be maintained constant irrespective of a change in the rotational speed of the rotor.

However, in the known pumps, means for dividing into first and second pressure chambers, the pressure chamber which is defined by the internal surface of the pump housing and the external surface of the movable ring, means for forming the throttle, and means for conducting pressurized fluids in front of and behind the throttle respectively to the first and second pressure chambers are provided separately. This makes the known pumps complicated in construction and high in cost.

SUMMARY OF THE INVENTION

It is therefore a primary object of the present invention to provide an improved vane type pump with a variable capacity which is simple in construction and low in cost.

Another object of the present invention is to provide an improved vane type pump of the character set forth above which is capable of changing the opening degree of a throttle in response to an electric signal supplied thereto, so that the discharge fluid volume of the pump can be varied notwithstanding a constant eccentricity of a movable member relative to a rotor rotated in a cylindrical bore of the movable member to maintain the pressure drop across the throttle constant.

Briefly, according to the present invention, there is provided a vane type pump with a vairable capacity, wherein a movable member having a cylindrical bore is movably received in a closed chamber of a pump housing so as to divide the closed chamber into a pressure chamber partly defined by an external surface of the movable member and a pump chamber partly defined by an internal surface of the cylindrical bore. A suction port communicating with an inlet port formed in the pump housing opens to a part of the pump chamber for leading fluid to the part of the pump chamber when rotation of a rotor received in the pump chamber causes a plurality of vanes to move along the internal surface of the cylindrical bore. A discharge port opens to another part of the pump chamber and conducts pressurized fluid from the other part of the pump chamber to the pressure chamber, which communicates with an outlet port formed in the pump housing. A sealing element seals a part of the pressure chamber so as to cut off a flow of pressurized fluid from the discharge port to the outlet port through the part of the pressure chamber. A valve element is provided at another part of the pressure chamber which is opposite the sealing element in the radial direction of the rotor and defines a throttle in cooperation with a part of the external surface of the movable member. The sealing element and the valve element divide the pressure chamber into first and second pressure chambers. Urging means act on the movable member to deflect the axis of the cylindrical bore from the axis of the rotor in the radial direction of the rotor. Pressurized fluid from the discharge port is conducted to the first pressure chamber and then is conducted to the second pressure chamber through the throttle. The throttle generates between the first and second pressure chambers a pressure difference, which causes the movable member to move against the urging means, whereby the eccentricity of the cylindrical bore relative to the rotor, and thus the discharge flow volume from the outlet port, is controlled to maintain the pressure difference between the first and second pressure chambers constant.

With this configuration, the valve element defining the throttle also acts as one of a pair of means for dividing the pressure chamber into the first and second pressure chambers. The incorporation of the throttle in the pressure chamber makes it possible to exclude means which are provided in the known pumps for conducting pressurized fluids in front of and behind the throttle respectively to the first and second pressure chambers. Accordingly, the pump according to the present invention is simple in construction and low in cost.

In another aspect of the present invention, the valve element is movable in the radial direction of the rotor, and a solenoid operated actuator is further provided. This actuator has a solenoid energized by an electric signal applied thereto and magnetically attracts the valve element so as to move the same in the radial direction of the rotor. This causes the opening degree of the throttle to change, thereby making it possible to change the pump discharge fluid volume in response to an input signal.

BRIEF DESCRIPTION OF THE DRAWINGS

The foregoing and other objects and many of the attendant advantages of the present invention will be readily appreciated as the same becomes better understood by reference to the following detailed description of preferred embodiments when considered in connection with the accompanying drawings, in which.

DETAILED DESCRIPTION OF THE PREFERRED EMBODIMENTS

Figure 2:
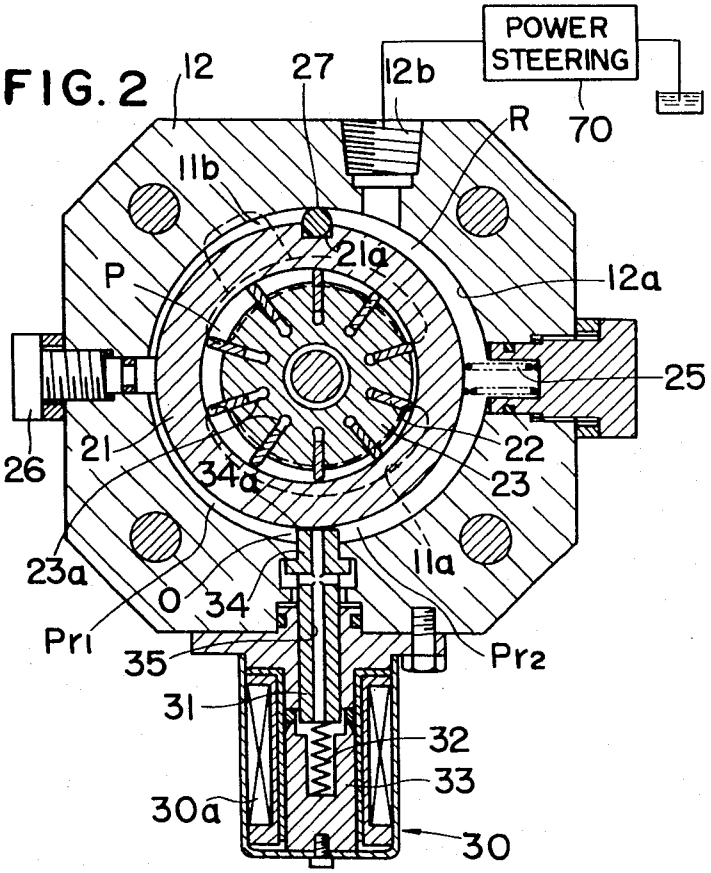
FIG. 2 shows a sectional view of the pump taken along the line II—II in FIG. 1.
Figure 1:
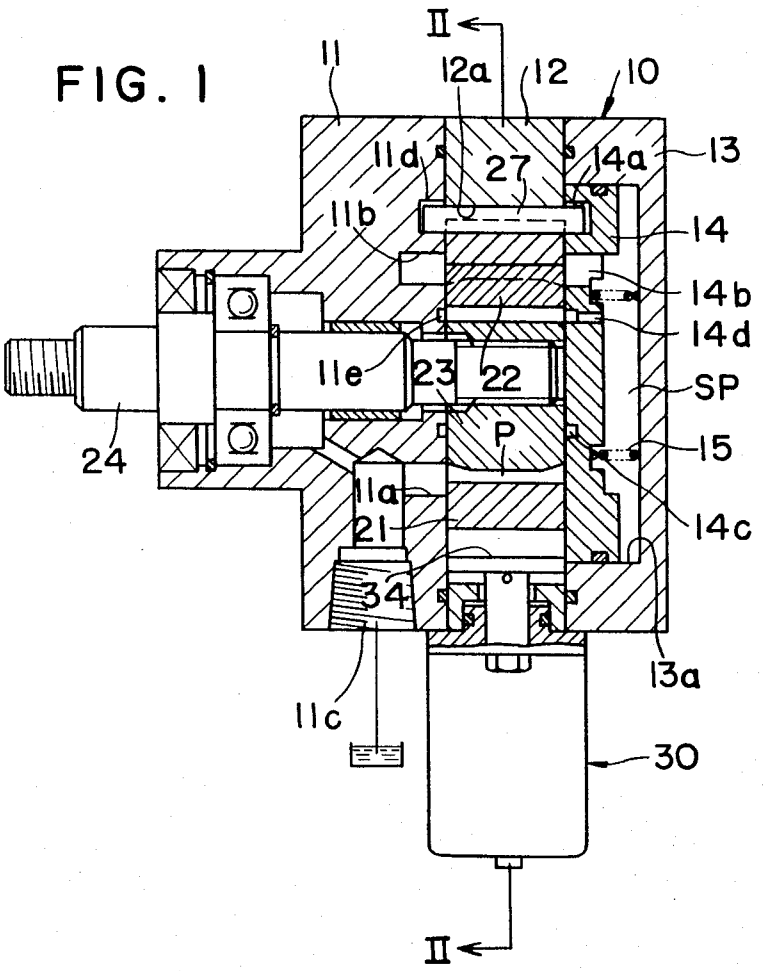
FIG. 1 shows a longitudinal sectional view of a vane type pump with a variable capacity according to the present invention.

Referring to the drawings, wherein like reference numerals designate identical or corresponding parts throughout the several views, and particularly to FIGS. 1 and 2 thereof, a vane type pump according to the present invention is shown having a pump housing 10, which comprises a front housing 11, a guide housing 12 and a rear housing 13. The guide housing 12 is formed with a bore 12*a*, in which is contained a movable ring 21, which in turn contains a rotor 23 having a plurality of vanes 22.

The movable ring 21 is perfectly circular and has an outer diameter which is considerably smaller than an internal diameter of the bore 12*a* of the guide housing 12. The movable ring 21 in the bore 12*a* is movable in a radial direction and provides a fluid chamber R between its circumferential external surface and an internal surface of the bore 12*a*. The rotor 23 is spline-engaged with one end of a drive shaft 24, which is fluid-tightly and rotatably supported in the front housing 11. The rotor 23 contained in the movable ring 21 provides a pump chamber P between its circumferential surface and an internal surface of the movable ring 21. The movable ring 21 is urged toward the left by a compression spring 25 provided at the right portion of the guide housing 12, as viewed in FIG. 2, and is in abutting engagement with a stop screw 26 disposed at a left portion of the guide housing 12. The stop screw 26 is provided for limiting the maximum eccentricity, and the movable ring 21, when in contact engagement with the stop screw 26, is at maximum eccentricity relative to the rotor 23.

The front housing 11 is formed with a suction port 11*a* and a discharge port 11*b* at an inside flat surface thereof. The suction port 11*a* is in fluid communication with an inlet port 11*c* provided in the front housing 11 and also with a suction area of the pump chamber P. The discharge port 11*b* is in fluid communication with a discharge area of the pump chamber P and the fluid chamber R. The rear housing 13 is formed at its inside flat surface with a side bore 13*a*, whose diameter is considerably larger than that of the bore 12*a* of the guide housing 12. Snugly fitted in the side bore 13*a* is a side pressure plate 14 of a circular shape, which is slidable in an axial direction of the drive shaft 24. The side pressure plate 14 defines between its right end surface and the rear housing 13 a side pressure chamber SP, which is in fluid communication with the discharge area of the pump chamber P through a communication passage 14*b* formed in the side pressure plate 14. The side pressure plate 14, biased by a compression spring 15 toward the left, as viewed in FIG. 1, is pressed upon the right side surface of the guide housing 12 when pressurized fluid is conducted into the side pressure chamber SP. The width of each of the movable ring 21, the rotor 23 and the vanes 22 is slightly narrower than that of the guide housing 12, so that when the side pressure plate 14 is pressed upon the guide housing 12, the movable ring 21, the rotor 23 and the vanes 22 face each of the front housing 11 and the rear housing 13 with a predetermined clearance. The side pressure plate 14 is formed at its left side surface with an annular groove 14*c*, which is in fluid communication, on one hand, with the side pressure chamber SP through a lead passage 14*d* formed in the side pressure plate 14 and on the other hand, with a plurality of vane receiving slots 23*a* radially formed in the rotor 23. A corresponding annular groove 11*e* is formed at the inside flat surface of the front housing 11.

The inside (i.e., right and left) flat surfaces of the front housing 11 and the side pressure plate 14 are respectively formed with elongated non-circular holes 11*d* and 14*a*, whose axes extend coaxially alongside an uppermost portion of the guide housing internal bore 12*a*. Opposite ends of a sealing pin 27 are inserted into the elongated holes 11*d* and 14*a*. Each of the elongated holes 11*d* and 14*a* has the same width as a diameter of the sealing pin 27 in the circumferential direction of the movable ring 21 and a wider width than the diameter of the sealing pin 27 in the radial direction of the movable ring 21, the holes lld and 14a extending slightly beyond the uppermost surface of the guide housing internal bore 12*a*. This enables a mid-portion of the cylindrical surface of the sealing pin 27 to fluid-tightly contact the uppermost surface of the guide housing internal bore 12*a*. The movable ring 21 is formed at the uppermost portion of its circumferential surface with an axial groove 21*a*, in which the mid-portion of the sealing pin 27 is snugly fitted. Since the discharge area of the pump chamber P is provided at the same position as the sealing pin 27 with respect to the circumference of the movable ring 21, pressurized fluid in the discharge area causes the movable ring 21 to move toward the sealing pin 27. Accordingly, the sealing pin 27 is reliably fitted in the axial groove 21*a* and is fluid-tightly contacted with the uppermost surface of the guide housing internal bore 12*a*. The fitting engagement of the sealing pin 27 with the axial groove 21*a* enables the movable ring 21 to pivot about the sealing pin 27 in the left-right direction, as viewed in FIG. 2. The fluid-tight contact engagement of the sealing pin 27 with the uppermost portion of the guide housing internal bore 12*a* provides a pair of separate fluid chambers at opposite sides of the sealing pin 27, as viewed in FIG. 2.

Fixed on a lower portion of the guide housing 12 is a magnetic solenoid valve 30 having a solenoid 30*a*, which is energized upon receipt of a control electric current supplied from an electric control circuit 40 shown in FIG. 3, as described later in detail. A moving core 31 of the solenoid valve 30 is provided with a valve element 34, which faces a part of the circumferential external surface of the movable ring 21 at a circumferential side opposite the sealing pin 27. The width of the valve element 34 in the axial direction of the rotor 23 is such that the valve element 34 lightly touches the right end surface of the front housing 11 and the left end surface of the side pressure plate 14, as viewed in FIG. 1. An axial psssage 35 for pressure balance is formed through the valve element 34 and the moving core 31 integrally provided therewith. The moving core 31 is urged by a compression spring 32, provided between itself and a yoke 33, toward the movable ring 21 and maintains the valve element 34 in contact with the movable ring 21 when the magnetic solenoid 30*a* is deenergized. The valve element 34 therefore establishes a variable throttle O between an inner end surface 34*a* thereof and a part of the circumferential external surface of the movable ring 21. Further, the valve element 34 cooperates with the sealing pin 27 to circumferentially divide the fluid chamber R into first and second pressure acting chambers Pr1 and Pr2, to which the discharge port 11*b* and an outlet port 12*b* respectively open. The outlet port 12*b* is connected to a power steering device 70.

Figure 4:
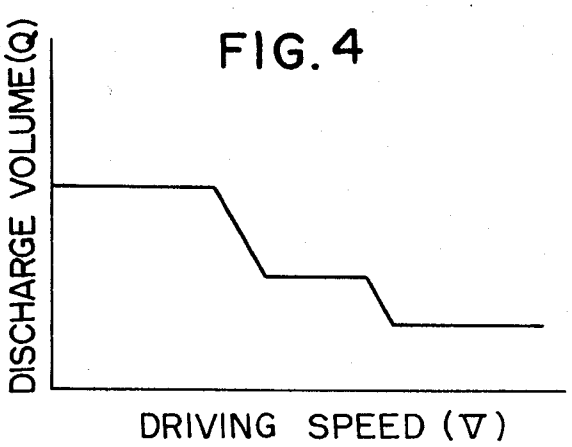
FIG. 4 shows a graph indicating an optimum relationship between various driving speeds and pump discharge volumes.
Figure 5:
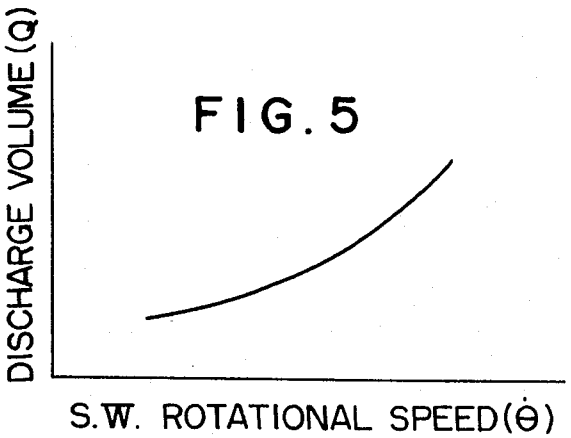
FIG. 5 shows a graph indicating an optimum relationship between various steering wheel rotational speeds and pump discharge volumes.
Figure 3:
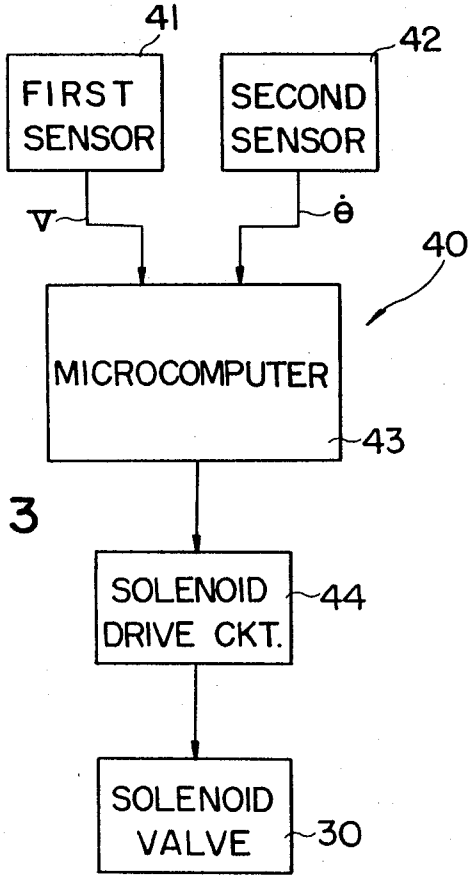
FIG. 3 shows a block diagram of an electric control circuit connected to a solenoid valve shown in FIGS. 1 and 2.

The electric control circuit 40 shown in FIG. 3 comprises a first sensor 41 for detecting the driving speed V of an automobile on which the vane type pump according to the present invention is mounted, a second sensor 42 for detecting the rotational speed $\theta$ of a steering wheel of the automobile, a microcomputer 43 for outputting a control signal corresponding to detection signals V and $\theta$ from the first and second sensors 41 and 42, and a drive circuit 44 for driving the solenoid 30 in response to the control signal from the microcomputer 43. The microcomputer 43 has stored various optimum pump discharge volumes Q relative to various automobile driving speeds V, as determined by the graph shown in FIG. 4 and various optimum pump discharge volumes Q relative to various steering wheel rotational speeds $\theta$, as determined by the graph shown in FIG. 5. Further, the microcomputer 43 is programmed to respond to the detection signals (i.e., a detected driving speed and a detected rotational speed) so as to thereby select from the various optimum pump discharge volumes Q optimum pump discharge volumes respectively corresponding to the detection signals. The programmed computer 43 processes these detection signals in a suitable manner so as to output a control signal to the drive circuit 44. For example, the microcomputer 43 outputs to the drive circuit 44 such a control signal that the discharge flow volume Q from the pump is decreased in response to an increase of the automobile driving speed V and is increased in response to an increase of the steering wheel rotational speed $\theta$.

The operation of the pump as constructed above will now be described with reference to the drawings. When the vane type pump is not in operation, the movable ring 21 is eccentric at a maximum distance, as shown in FIG. 2. When the starting of the automobile engine (not shown) causes integral rotation of the drive shaft 24 and the rotor 23, fluid is sucked into the pump chamber P via the inlet port 11*c* and the suction port 11*a*, and pressurized fluid is discharged into the first fluid acting chamber Pr1 via the discharge port 11*b*. The pressurized fluid then flows into the second fluid acting chamber Pr2 through the variable throttle O and is supplied from the outlet port 12*b* to the power steering device 70.

During the operation of the pump, the electric control circuit shown in FIG. 3 applies the detection signal indicative of a driving speed output V from the first sensor 41 to the microcomputer 43, which thus calculates an optimum pump discharge volume Q corresponding to the driving speed V at that moment so as to output to the drive circuit 44 a control signal indicative of the calculated optimum pump discharge volume Q. Therefore, the drive circuit 44 applies to the solenoid valve 30 a contrbl electric current corresponding to the control signal from the microcomputer 43. The solenoid 30*a* of the solenoid valve 30 thus generates through the yoke 33 a magnetic attractive force corresponding to the detected driving speed V of the automobile and displaces the valve element 34 along with the moving core 31 against the force of the spring 32, whereby the opening degree of the variable throttle O is controlled by the displacement of the valve element 34.

An increase in rotational speed of the drive shaft 24 and the rotor 23 (i.e., pump rotational speed) causes the volume of pressurized fluid supplied into the first fluid acting chamber Pr1 to increase. This results in generating between the first and second fluid acting chambers Pr1 and Pr2 a pressure difference whose magnitude depends upon the opening degree of the variable throttle O. When the pressure difference exceeds a predetermined value, the movable ring 21 is pivoted about the sealing pin 27 against the force of the spring 25 toward the right, as viewed in FIG. 2. Consequently, the eccentricity of the movable ring 21 relative to the rotor 23 is decreased in proportion to an increase of the pressure difference so as to thereby decrease the pump discharge volume per rotation, whereby the discharge volume of the pump can be controlled as indicated by the driving speed V-to-discharge volume Q characteristics shown in FIG. 4.

Furthermore, when the steering wheel is rotated in the aforementioned operation of the pump, the rotational speed $\theta$ of the steering wheel is detected by the second sensor 42, whose detection signal is applied to the microcomputer 43. In response to the detection signals V and $\theta$ from the first and second sensors 41 and 42, the microcomputer 43 calculates an optimum pump discharge volume Q corresponding to both of the detected driving speed V and the detected steering wheel rotational speed $\theta$ and outputs a control signal indicative of the optimum pump discharge volume Q. The drive circuit 44 responds to the control signal from the microcomputer 43 and applies to the solenoid 30*a* of the solenoid valve 30 a control electric current corresponding to the control signal. As a result, the solenoid 30*a* in this case generates through the yoke 33 a magnetic attractive force corresponding to the detected driving speed V and the detected steering wheel rotational speed $\theta$ and displaces the valve element 34 along with the moving core 31. This causes the pressure difference between the first and second fluid acting chambers Pr1 and Pr2 to change depending upon the driving speed V as well as the steering wheel rotational speed $\theta$, whereby the discharge volume Q of the pump is controlled as indicated by the driving speed V-to-discharge volume Q characteristics and the steering wheel rotational speed $\theta$-to-discharge volume Q characteristics respectively shown in FIGS. 4 and 5. In this particular embodiment, in the event that the steering wheel is rapidly rotated, the opening degree of the variable throttle O is temporarily increased even when a high speed driving of the automobile maintains a decreased discharge volume from the pump. Accordingly, even during high speed driving of the automobile, such temporary increase in the opening degree of the variable throttle O causes the discharge volume Q from the pump to increase, thereby supplying the power steering device 70 with an increased volume of pressurized fluid.

Although the electric control circuit in this particular embodiment controls the control current supplied to the solenoid valve 30 in dependence upon an automobile driving speed and the steering wheel rotational speed, the present invention is not limited to using the automobile driving speed and the steering wheel rotational speed as control inputs. The present invention may otherwise be practiced by controlling the control electric current applied to the solenoid valve 30 in dependence upon various other control inputs.

Figure 7:
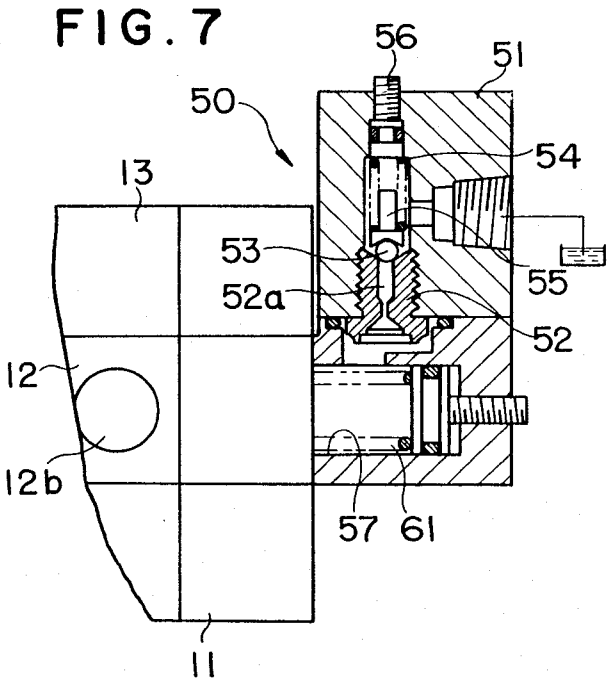
FIG. 7 shows a fragmentary sectional view of the pump taken along the line VII—VII in FIG. 6.
Figure 6:
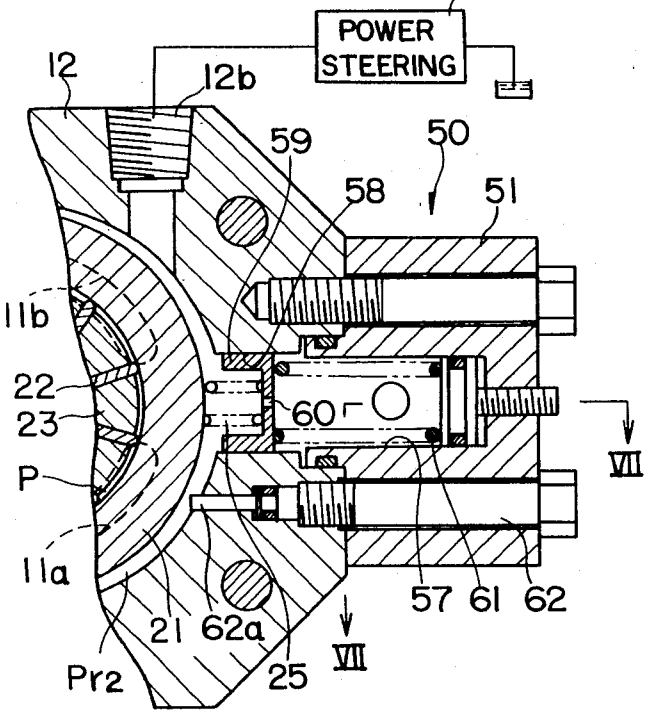
FIG. 6 shows a fragmentary sectional view of another embodiment of the pump according to the present invention.

FIGS. 6 and 7 show another embodiment of the vane type pump according to the present invention, wherein a relief valve 50 is incorporated in the pump. The relief valve 50 includes a valve body 51 secured to the guide housing 12, a valve seat member 52 formed with relief passage 52*a* therethrough, a steel ball valve member 53 and a spring 54 urging, through a spring shoe 55, the steel ball 53 valve member to close the relief passage 52*a*. The force of the spring 54 is adjustable by an adjusting screw 56 so that the pressure of fluid which causes the steel ball 53 to open the relief passage 52*a* can be adjusted to a desired value (e.g., 70 kg/cm$^2$). The relief passage 52*a* is in fluid communication with a blind hole 57, which is formed in the valve body 51 on a line extending from the stop screw 26 (in FIG. 2) and passing through the center of rotation of the rotor 23. The guide housing 12 is further formed with through hole 58, in axial alignment with the blind hole 57, and opening to the blind hole 57 at one side and to the second fluid acting chamber Pr2 on the other side. The through hole 58 slidably receives a control spool 59 having an orifice 60. The control spool 59 also serves as a spring shoe to support the spring 25 that is in abutting engagement with the movable ring 21. A control spring 61 is provided in the blind hole 57 to support the control spool 59. The pump in this embodiment is further provided with a stop bolt 62, which extends in parallel relation with the axis of the blind hole 57, and passes through the valve body 51 and the guide housing 12. An inner end portion 62*a* of the stop bolt 62 extends into the second fluid acting chamber Pr2 and is engageable with the movable ring 21 for preventing the movable ring 21 from deflecting to the right such that its axis is to the right of the axis of the rotor 23, as viewed in FIG. 6.

In the operation of the pump, pressurized fluid conducted into the second fluid acting chamber Pr2 is discharged from the outlet port 12*b* to the power steering device, as described earlier. Since the blind hole 57 is in fluid communication with the second fluid acting chamber Pr2 through the orifice 60 of the control spool 59, a pressure balance is maintained between the blind hole 57 and the second fluid chamber Pr2 while the relief passage 52*a* is closed by the steel ball 53. This keeps the control spool 59 fixed, whereby only the spring 25 acts against the movement of the movable ring 21. When the steering wheel is rapidly rotated with the automobile being stopped, the pressure of fluid in the second fluid acting chamber Pr2 may attain a relief action pressure, for example, 70 kg/cm$^2$, in which event the steel ball 53 is moved from the position closing the relief passage 52*a*, so as to thereby vent a part of the pressurized fluid. As the pressure in the blind hole 57 is decreased relative to that in the second fluid acting chamber Pr2, the control spool 59 moves to the right and this results in weakening the force of the spring 25 against the movement of the movable ring 21. Consequently, the movable ring 21 is permitted to move, bringing its axis toward the axis of the rotor 23, whereby the discharge volume per rotation of the pump is decreased to reduce the power loss of the automobile engine. When the axis of the movable ring 21 coincides with the axis of the rotor 23, the ring 21 comes into abutting engagement with the inner end portion 62*a* of the stop bolt 62.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A vane type pump with a variable capacity for a power steering device, comprising:

a pump housing having an inlet port and an outlet port and defining a closed chamber therein, a part of said closed chamber being defined by a pair of flat end surfaces extending in parallel relation;

a movable member received in said closed chamber and guided by said pair of said flat end surfaces for movement in said closed chamber, said movable member having a cylindrical bore for dividing said closed chamber into a pressure chamber partly defined by an external surface of said movable member and a pump chamber partly defined by an internal surface of said cylindrical bore;

a drive shaft supported in said pump housing for rotation about an axis parallel to the axis of said cylindrical bore and having one end thereof extending into said pump chamber;

a rotor received in said pump chamber and connected with said one end of said drive shaft for integral rotation therewith, said rotor being formed with a plurality of radial slots at its circumferential surface;

a plurality of vanes respectively received in said plurality of radial slots and movable radially of said rotor and along said internal surface of said cylindrical bore;

urging means for urging said movable member to move in a radial direction of said rotor so as to deflect the axis of said movable member from the axis of said rotor;

a suction port formed on one of said pair of said flat end surfaces of said pump housing at a position opening to a first part of said pump chamber, said suction port communicating with said inlet port for conducting fluid to said first part of said pump chamber;

a discharge port formed on one of said pair of said flat end surfaces of said pump housing at a position opening to another part of said pump chamber and communicating with said pressure chamber for discharging pressurized fluid from said pump chamber to said pressure chamber;

sealing means forming a seal in a first part of said pressure chamber for cutting off a flow of pressurized fluid from said discharge port into said outlet port through said first part of said pressure chamber;

a valve element at another part of said pressure chamber which is opposite said sealing means in the radial direction of said rotor and is movable in said radial direction of said rotor, said valve element defining a throttle in cooperation with a part of said external surface of said movable member for dividing said pressure chamber into first and second pressure chamber portions respectively communicating with said discharge port and said outlet port, thereby generating a pressure difference between said first and second pressure chamber portions; and a solenoid operated actuator secured to said pump housing and having a solenoid energized by an electric signal applied thereto for magnetically attracting said valve element so as to move said valve element in said radial direction of said rotor.

2. A vane type pump as set forth in claim 1, wherein said pump housing includes:

a pressure plate snugly received in a cylindrical bore formed in said pump housing, said pressure plate being slidable in said axial direction of said rotor, said pressure plate forming one of said pair of said flat end surfaces, said flat end surfaces defining the limits of said pressure chamber and said pump chamber in said axial direction of said rotor, said pressure plate being further formed with a passage for conducting pressurized fluid from said pump chamber to a piston chamber defined by said cylindrical bore and said pressure plate; and urging means provided in said piston chamber for urging said pressure plate toward one axial end of said rotor.

3. A vane type pump as set forth in claim 1, wherein:

said closed chamber of said pump housing is a closed cylindrical bore;

said movable member comprises a ring member whose axis extends in parallel relation with the axis of said closed cylindrical bore; and said sealing means comprises a round pin which is fitted in an axial groove formed at a part of a circumferential surface of said ring member and which contacts an internal surface of said closed cylindrical bore.

4. A vane type pump as set forth in claim 3, wherein:

said discharge port is located between said round pin and said drive shaft in said radial direction of said rotor.

5. A vane type pump as set forth in claim 1, further comprising:

a relief valve having a vent passage communicating with said second pressure chamber portion and operable for opening said vent passage when the pressure of pressurized fluid in said second pressure chamber portion exceeds a predetermined value.

6. A vane type pump as set forth in claim 5, wherein said urging means comprises:

a spool received in a hole formed in said pump housing and slidable in said radial direction of said rotor, said spool defining a part of said hole as a control chamber separated from said second pressure chamber portion, said spool having an orifice for permitting a limited volume of pressurized fluid to flow from said second pressure chamber portion to said control chamber which communicates said vent passage of said relief valve;

a first spring provided in said control chamber for urging said spool toward said movable member; and a second spring provided between said spool and said movable member for urging said movable member in a radial direction to move the axis of said cylindrical bore of said movable member from the axis of said rotor.

7. A vane type pump as set forth in claim 6, further comprising:

a first stop abuttable with said movable member for limiting eccentric movement of said movable member in said radial direction of said rotor; and a second stop abuttable with said movable member for limiting eccentric movement of said movable member in said radial direction of said rotor.

8. A vane type pump as set forth in claim 1, further comprising:

input sensor means for detecting at least one control input;

a computer responsive to said at least one control input from said input sensor means for processing said at least one control input so as to output a control signal indicative of an optimum discharge fluid volume to be discharged from said vane type pump; and a solenoid drive circuit responsive to said control signal from said computer for applying to said solenoid of said solenoid operated actuator said electrical signal corresponding to said control signal.

* * * * *